United States Patent [19]

Wiesemann

[11] Patent Number: 4,961,540

[45] Date of Patent: Oct. 9, 1990

[54] THREE SHAFT COMMINUTION APPARATUS

[75] Inventor: Bruce O. Wiesemann, South Pasadena, Fla.

[73] Assignee: Wiesemann Enterprises, Inc., Largo, Fla.

[21] Appl. No.: 401,419

[22] Filed: Aug. 31, 1989

[51] Int. Cl.[5] ..... B02C 18/06

[52] U.S. Cl. ..... 241/46 B; 241/46.06; 241/236

[58] Field of Search ..... 241/46 R, 46 B, 46.06, 241/235, 236, 166, 167

[56] References Cited

U.S. PATENT DOCUMENTS

| | | | |
|---|---|---|---|
| 2,894,697 | 7/1959 | Panning et al. | 241/167 X |
| 3,396,914 | 8/1968 | Liebman | 241/236 X |
| 3,596,842 | 8/1971 | Barber | 241/166 X |
| 4,046,324 | 9/1977 | Chambers | 241/ |
| 4,194,698 | 3/1980 | Kosmowski | 241/ |
| 4,702,422 | 10/1987 | Chambers et al. | 241/ |

*Primary Examiner*—Timothy V. Eley
*Attorney, Agent, or Firm*—Herbert W. Larson

[57] ABSTRACT

Three parallel hydraulically driven shafts are mounted on a pair of bearing plates attached to the side plates of a housing containing a comminution chamber for receipt of waste water effluent. The waste water effluent stream enters the comminution chamber transverse to the three shafts. Two shafts support a stack of spaced apart tooth cutters. Toothed cutters are positioned so that each level is in the same plane as a toothed cutter in the opposite shaft. The third shaft is positioned distal from the input of the waste water effluent and behind the first two shafts. The third shaft supports a stack of shearing cutters overlapping the toothed cutters. Each shearing cutter is on a plane with a spacer disk between each toothed cutter. Debris in the water effluent such as rag material is caught by the toothed cutters and shredded by the scissors action of the shearing cutter against the toothed cutters.

17 Claims, 5 Drawing Sheets

THREE SHAFT COMMINUTION APPARATUS

BACKGROUND OF THE INVENTION

1. Field of The Invention

This invention relates to shearing machinery employed in a water environment. More particularly, it refers to a three shaft apparatus having on each of two shafts a hooked cutter blade and on the other shaft, a shearing cutter with two knife edges.

2. Description of The Prior Art

Currently employed commercial grinding and shearing machines rip up water borne debris such as wood or rags with a two shaft cutting system with each cutter blade turning towards each other and cutting in a scissors type action. A machine used to shred paper having this two shaft configuration is described in U.S. Pat. No. 4,194,698. U.S. Pat. Nos. 4,702,422 and 4,046,324 also disclose two shaft grinders. Although the grinding and shearing machines disclosed in these patents work effectively to cut debris, they suffer from periodic jamming because cloth strips become entangled around the cutting blades and the machines cannot generate enough torque to rip free. This necessitates wasted down time to clean the cutting blades. A grinding and shearing machine is needed which will cut wet rags or other waste cloth without jamming.

SUMMARY OF THE INVENTION

I have invented a three shaft shearing machine which cuts wet rags and other waste cloth without jamming in the manner of prior art machines.

My machine has a housing enclosing three parallel shafts mounted through end plates of the housing and located transverse to the direction of flow of waste water into a comminution chamber within the housing. A pair of bearing plates are spaced apart and outboard from the end plates but are attached to side plates of the housing. The bearing plates support hydraulic drive motors and shaft housings for each of the three shafts.

All the shafts have a hexagonal shape in cross section for the portion of the shaft located within the comminution chamber. A stack of spaced apart tooth cutters are mounted on two of the shafts within the comminution chamber. One shaft turns clockwise and the other counterclockwise so they turn towards each other. A tooth cutter is co-planer, but spaced apart from a corresponding tooth cutter of the adjacent shaft. The co-planer tooth cutters turn towards each other.

The third shaft is located distal from waste water input flow and behind the first two shafts. The third shaft supports a stack of shearing cutters having two cutting edges. The shearing cutters overlap the tooth cutters and each shearing cutter is co-planer with a spacing disk between each tooth cutter. The third shaft turns at about twice the revolutions per minute as the first two shafts. Rags and other debris in the waste stream is hooked by the tooth cutters and is cut by a shearing or scissor action between the shearing cutter and the tooth cutters. Hydraulic drive motors operate the shafts.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
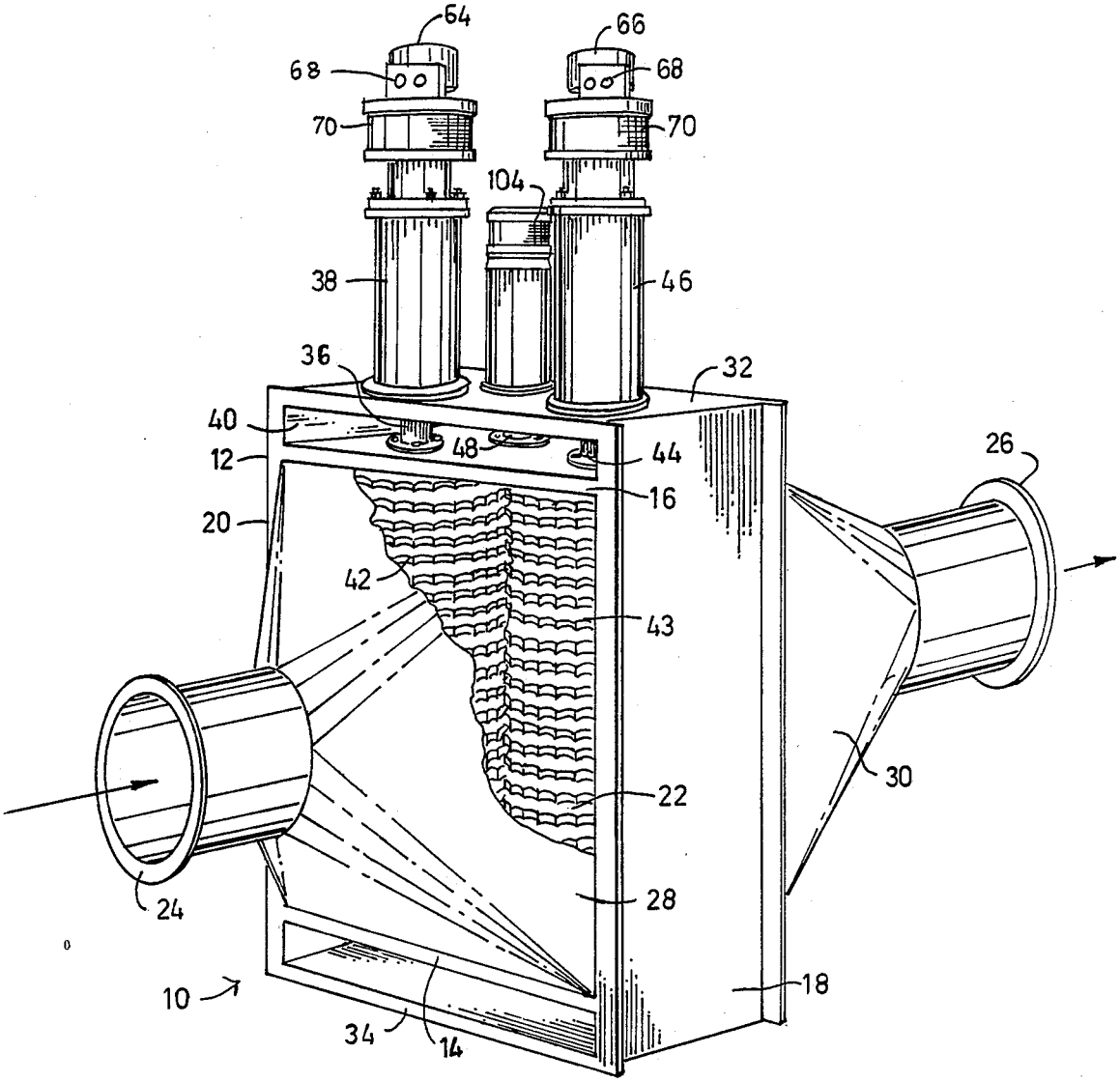
FIG. 1 is a partially cut away front perspective view of the grinding machine of this invention.

Throughout the following detailed description, the same reference numerals refer to the same elements in all figures.

The three shaft comminution apparatus 10 of this invention is shown in FIG. 1. The apparatus has a housing 12 which is made up of a bottom housing plate 14, a top housing plate 16 and side walls 18 and 20. The housing encloses a comminution chamber 22. Input pipe 24 leads waste water effluent into the comminution chamber 22 and output pipe 26 removes the waste water after passing through the comminution chamber 22. The input source can be mounted in a plate 28 on the front of the comminution chamber and the pipe 26 can be mounted on a plate 30 on the back of the comminution chamber 22. However, both the front and back of housing 12 can be open with the waste water effluent directed into the front portion of the comminution chamber.

A top bearing plate 32 and a bottom bearing plate 34 are also attached to the side plates 18 and 20. The bearing plates support three shafts. The first shaft 36 has a housing 38 enclosing the top portion of the shaft. The shaft passes through the space 40 between the top bearing plate 32 and the top of the housing 16. In the portion of shaft 36 within the comminution chamber, it supports a stack of tooth cutters 42. In like manner, shaft 44 has a housing 46 and it likewise passes through space 40. A stack of tooth cutters 43 are mounted on the portion of shaft 44 located within the comminution chamber.

Figure 4:
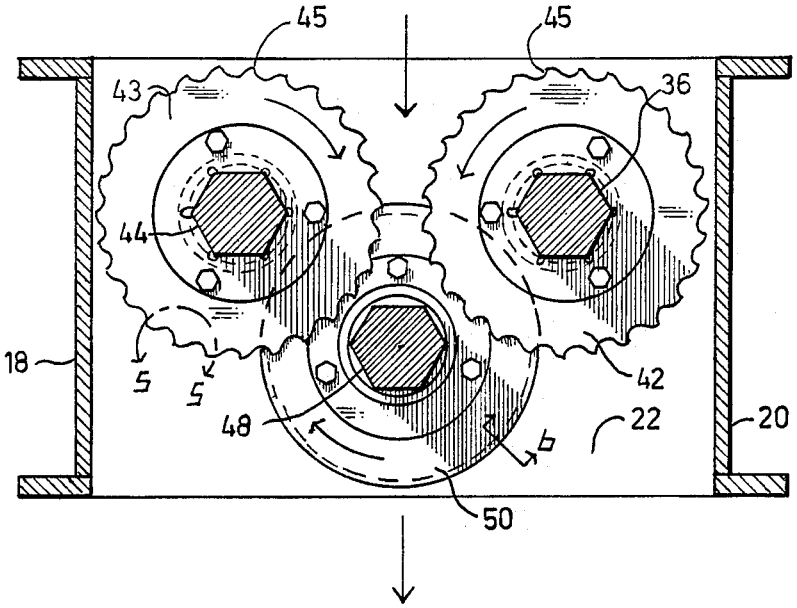
FIG. 4 is a section view along lines 4—4 of FIG. 3.
Figure 5:
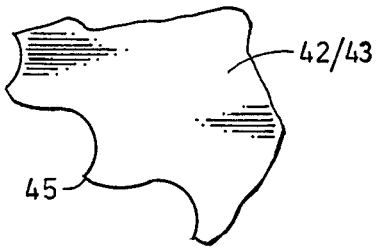
FIG. 5 is a section view along lines 5—5 of FIG. 4.

The tooth cutters, as seen in FIGS. 4 and 5, have a tooth configuration 45 along their peripheral edges. The central portion of the cutters 42 and 43 have a hexagonal opening so that the cutters fit the shafts on which they are mounted. Shafts 36 and 44 support co-planer cutter blades 42 and 43 respectively. As can be seen most clearly in FIG. 4, shafts 36 and 44 are located at the front or water input portion of the comminution chamber and the third shaft 48 is located distal from the water input source and is on a plane behind the first two shafts.

Figure 6:
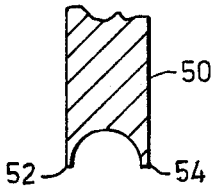
FIG. 6 is a section view along lines 6—6 of FIG. 4.

Shaft 48 supports a stack of shearing cutters 50 having knife edges 52 and 54 as seen in FIG. 6. The shearing cutters 50 are located on planes below or above, the cutters 42 and 43. They are on the same plane as the disk shaped spacers 56 between each tooth cutter 42 or 43. Rotation of cutter 50 cuts cloth and other debris in the water effluent picked up by tooth 45. The cutting is done in a scissor type action between the cutter 50 and the cutters 42 and 43.

Figure 2:
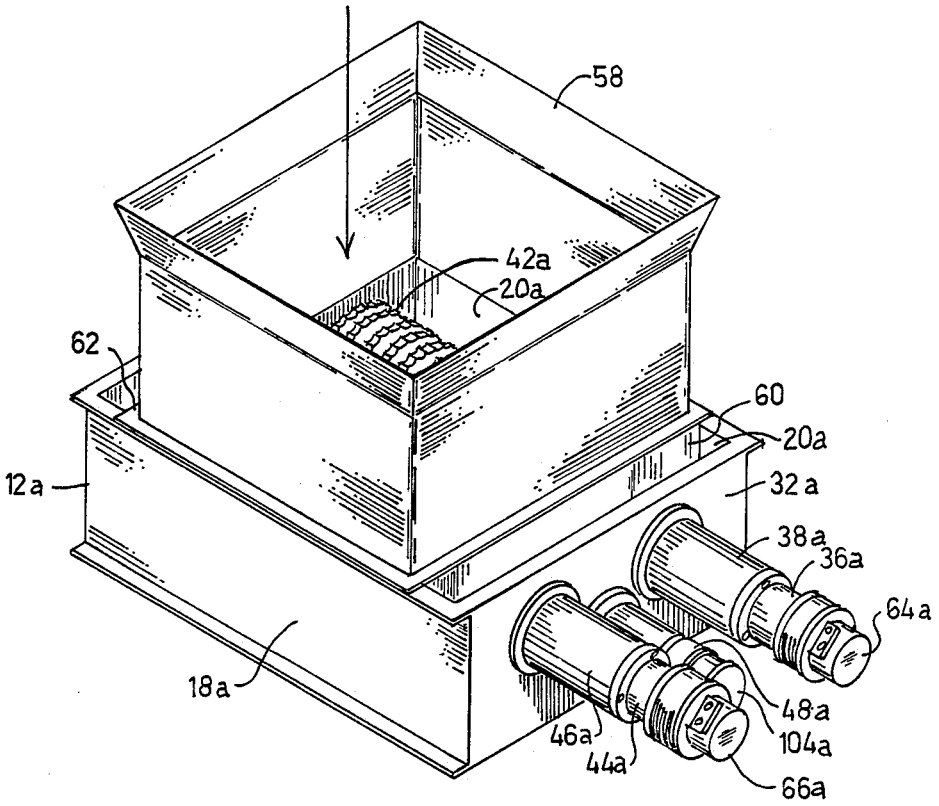
FIG. 2 is a perspective view of an alternate embodiment of the grinding machine.

In an alternative embodiment of the comminution apparatus, as seen in FIG. 2, the housing **12*a* is placed below the waste water effluent input source. A guide channel 58 attached to housing plates 60 and 62, permits the waste water to hit the cutters 42, 43 and 50 transversely. The apparatus of FIG. 2 operates in the same manner as the vertical apparatus shown in FIGS. 1 and 3**.

In the apparatus of FIG. 2, the sidewalls 18*a* and 20*a* support bearing plate 32*a* which supports the shafts 36*a*, 44*a* and 48*a*, as well as their housings such as 46*a* and 38*a*. The hydraulic drive motors 64*a*, 66*a* and 104*a* are located at the end of their respective shafts.

Figure 3:
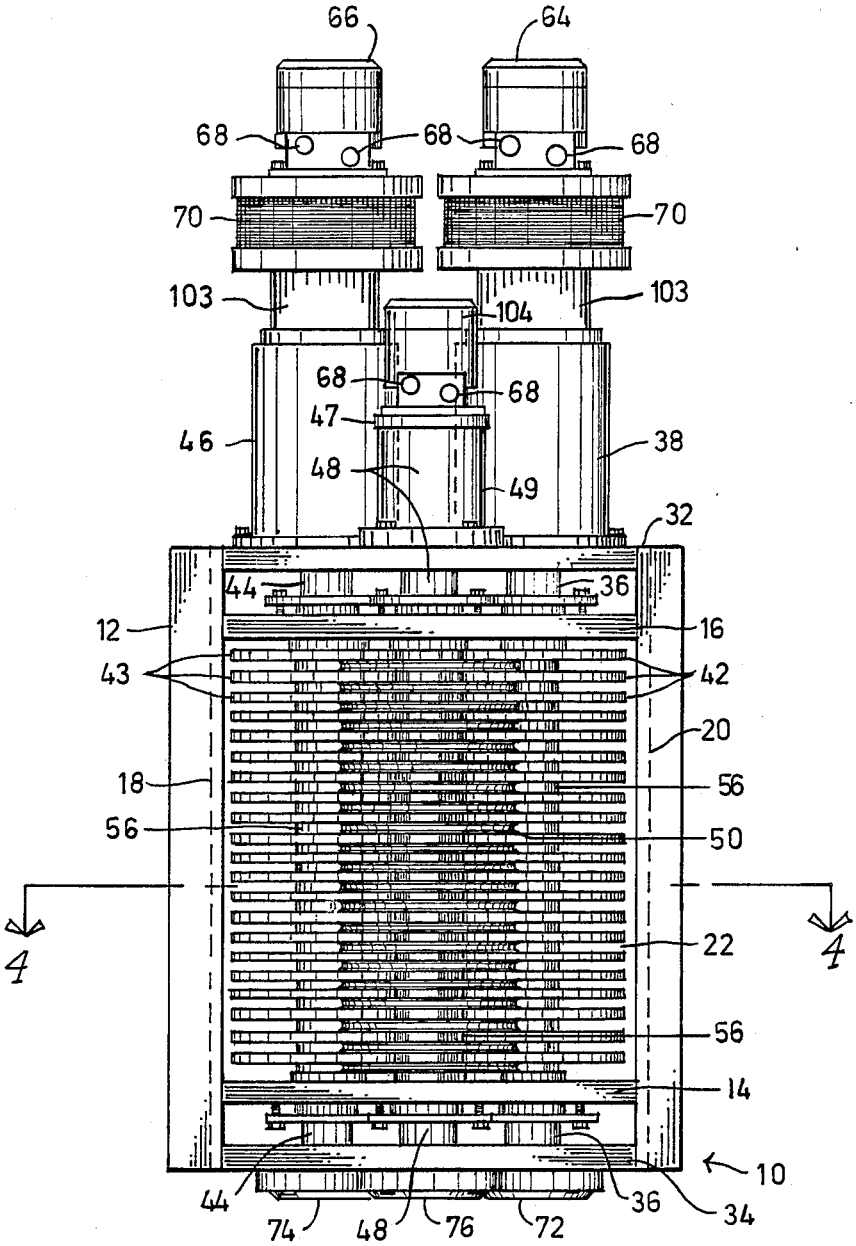
FIG. 3 is a rear elevation view of the machine of FIG. 1.

Referring to FIG. 3, shafts 36 and 44 are driven by hydraulic drive motors 64 and 66 respectively. Hydraulic lines 68 entering the drive motors provide the fluid input. A planetary gear 70 attached to each motor provides a five to one reduction to the shafts. A bearing cover 72 caps the bottom of shaft 36. Bearing cover plate 74 caps the bottom of shaft 44 and bearing cover plate 76 caps the bottom of shaft 48.

Figure 7:
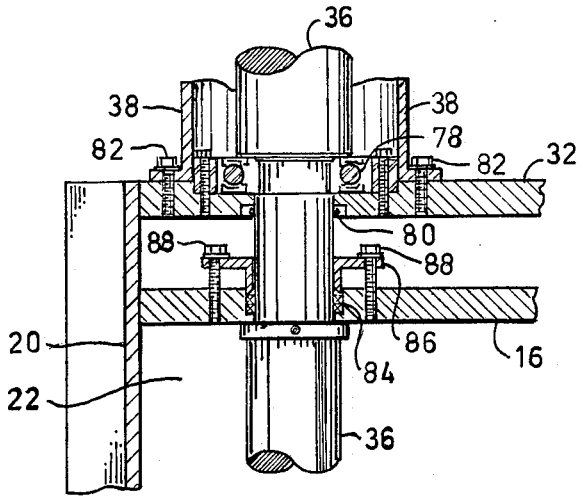
FIG. 7 is a section view of a top bearing and shaft assembly for the machine.
Figure 8:
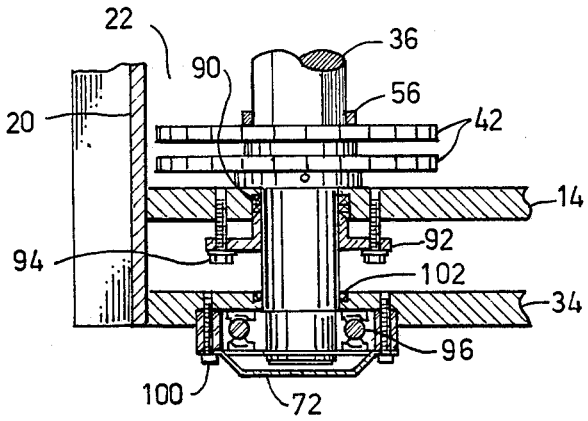
FIG. 8 is a section view of a bottom bearing and shaft assembly for the machine.

Referring to FIGS. 7 and 8, using shaft 36 as an example, the shaft is supported on the top of bearing plate 32 by a pair of cutter shaft bearings 78. Packing gland 80 seals the shaft to the bearing plate 32. The shaft housing 38 is held in place by hex nuts 82. At the point where shaft 36 passes through plate 16, additional drive shaft packing 84 is inserted to seal the shaft and prevent water leakage from the comminution chamber 22. The packing 84 is held in place by packing gland ring 86 which is also held in place by hex nuts 88. As seen in FIG. 8, the bottom of shaft 36 is held in place by packing gland ring 92, which in turn is held in place by hex screws 94 attached to plate 14. Leakage through the opening in plate 14 from the comminution chamber 22 is prevented by drive shaft packing 90. The end of the shaft 36 is supported by a pair of bottom bearings 96. A retaining ring 98 prevents the shaft from moving and the cover plate 72 held in place by screws 100 cap off the bottom of shaft 36. A packing gland 102 is also inserted to prevent any leakage.

The third shaft 48 is held in place in the same manner as shaft 36 but is driven by hydraulic drive motor 104 and does not require a planetary gear.

The flow pipe 24 into the comminution chamber is usually about sixteen inches to provide typical waste water flow.

The hydraulic drive motors 64, 66 and 104 used in this invention, preferably generate ten to twenty horsepower. However, lower or higher power requirements as needed can be used. The planetary gear reducers 70 have a five to one reduction ratio to reduce the speed of the hydraulic motors. There is no gear reduction mounted to motor 104. Therefore, shaft 48 turns at approximately twice the speed as shafts 36 and 44.

Normally, cutters 42 and 43 turn at approximately one hundred revolutions per minute and cutter 50 turns at two hundred revolutions per minute.

As stated previously, the corresponding hooked cutters 42 and 43 are located on the same plane on adjacent shafts 36 and 44, respectively. The cutters 42 and 43 are mounted so there is about a one inch horizontal gap between the hooked edges 45.

Cutters are stacked apart vertically in the apparatus of FIGS. 1 and 3 at approximately 0.4 to 0.5 inches and preferably 0.46 inches and have a running clearance preferably of about 0.03 inches. However, the running clearance can vary from 0.008 to 0.016 inches.

The materials used to construct the comminution apparatus are high grade stainless steel to prevent rusting.

Having thus described the invention, what is claimed and desired to be secured by Letters Patent is:

1. A comminution apparatus for solid waste materials in a waste water effluent stream comprising:

a housing having oppositely positioned side plates and end plates enclosing a comminution chamber together with input and output ports for directing the water borne waste through the comminution chamber, the housing enclosing parallel first, second and third shafts mounted transverse to the direction of flow of the waste water, the first and second shaft each supporting multiple spaced apart cutter blades with a toothed end, the first shaft capable of turning in a clockwise direction and the second shaft capable of turning in a counter clockwise direction, each toothed cutter blade on a first or second shaft being co-planer with a toothed cutter blade from the other shaft, the third shaft supporting multiple spaced apart shearing cutters with at least one knife edge on each cutter, the third shaft cutters overlapping adjacent first and second shaft toothed cutters, the third shaft being mounted distal from the waste water input flow behind the first and second shaft mounted proximal to the waste water input flow, and a pair of bearing plates parallel to but spaced apart from each housing end plate attached to the housing side plates, the bearing plates supporting a means for driving the shafts.

2. A comminution apparatus according to claim 1 wherein each cutter blade on the first and second shaft is spaced apart in a vertical direction from an adjacent cutter blade by a disk shaped spacing element.

3. A comminution apparatus according to claim 2 wherein each shearing cutter on the third shaft is co-planer with a spacing element on the first and second shaft.

4. A comminution apparatus according to claim 3 wherein each shearing cutter has two knife edges overlapping a cutter blade from each of the first and second shafts.

5. A comminution apparatus according to claim 1 wherein the cutter blades on the first and second shaft are spaced apart in a horizontal plane by about one inch and in a vertical plane on each of the first and second shafts at about 0.4 to 0.5 inches.

6. A comminution apparatus according to claim 1 wherein the third shaft turns at about twice the revolutions per minute as the first and second shafts.

7. A comminution apparatus according to claim 1 wherein the waste water enters the comminution chamber at a right angle to the longitudinal axis of the chamber.

8. A comminution apparatus according to claim 1 wherein the comminution chamber is located below the flow of waste water.

9. A comminution apparatus according to claim 1 wherein the means for driving each shaft is a hydraulic drive motor.

10. A comminution apparatus according to claim 9 wherein the hydraulic drive motors driving the first and second shafts are located adjacent a planetary gear providing a five to one reduction to the turns of each shaft.

11. A comminution apparatus for solid waste materials in a waste water effluent stream comprising:

a housing enclosing a comminution chamber for receiving water borne waste, the housing enclosing a portion of a first, a second and a third shaft in parallel alignment to each other, with the waste effluent stream transverse to a longitudinal direction of the shafts, each shaft portion within the comminution chamber supporting multiple spaced apart blades for cutting or ripping apart rag type debris in the waste effluent, the first and second shaft mounted proximal to the flow of waste water effluent and the third shaft mounted distal from the waste water effluent, and a hydraulic motor driving each shaft, the hydraulic motors located exterior of the comminution chamber.

12. The comminution apparatus according to claim 11 wherein the spaced apart blades on the first and second shafts are toothed cutter blades and the blades on the third shaft are shearing cutters having at least one knife edge.

13. The comminution apparatus according to claim 12 wherein each toothed cutter from the first shaft is co-planer with a corresponding toothed cutter from the second shaft and each toothed cutter is separated in a vertical direction on the shaft by a spacer disk.

14. The comminution apparatus according to claim 13 wherein a shearing cutter from the third shaft is co-planer with a spacer disk from the first and second shaft.

15. The comminution apparatus according to claim 12 wherein there are two knife edges on each shearing cutter.

16. The comminution apparatus according to claim 11 wherein the third shaft turns at about a 2:1 ratio with respect to the first and second shafts.

17. The comminution apparatus according to claim 11 wherein the housing has two side walls and a top and bottom wall and each shaft has a water tight seal at a point where it passes through the top and bottom wall.

* * * * *